US010777934B2

(12) United States Patent
Yi et al.

(10) Patent No.: US 10,777,934 B2
(45) Date of Patent: Sep. 15, 2020

(54) ELECTRICAL CONNECTOR WHICH ACCEPTS DIFFERENT SEAL CONFIGURATIONS

(71) Applicants: TE CONNECTIVITY CORPORATION, Berwyn, PA (US); TYCO ELECTRONICS AMP ITALIA S.R.L., Collegno (Turin) (IT)

(72) Inventors: Chong Hun Yi, Mechanicsburg, PA (US); Christopher A. Rowland, Harrisburg, PA (US); Fulvio Calvone, Collegno (IT)

(73) Assignees: TE CONNECTIVITY CORPORATION, Berwyn, PA (US); TE CONNECTIVITY ITALIA DISTRIBUTION S.r.l., Collegno (IT)

( * ) Notice: Subject to any disclaimer, the term of this patent is extended or adjusted under 35 U.S.C. 154(b) by 0 days.

(21) Appl. No.: 16/035,739

(22) Filed: Jul. 16, 2018

(65) Prior Publication Data

US 2020/0021057 A1 Jan. 16, 2020

(51) Int. Cl.
*H01R 13/52* (2006.01)
*H01R 13/506* (2006.01)
*H01R 13/627* (2006.01)

(52) U.S. Cl.
CPC ..... *H01R 13/5205* (2013.01); *H01R 13/506* (2013.01); *H01R 13/5219* (2013.01); *H01R 13/6272* (2013.01)

(58) Field of Classification Search
CPC ..... H01R 13/5202; H01R 13/5205; H01R 13/5208; H01R 13/5221; H01R 13/5219; H01R 13/506; H01R 13/6272
See application file for complete search history.

(56) References Cited

U.S. PATENT DOCUMENTS 4,772,231 A * 9/1988 Hayes ..... H01R 13/5221 439/272
4,810,208 A * 3/1989 Hayes ..... H01R 13/5208 439/281

(Continued)

FOREIGN PATENT DOCUMENTS

WO 95/28021 A1 10/1995

OTHER PUBLICATIONS

International Search Report, International Application No. PCT/IB2019/056022, International Filing Date, Jul. 15, 2019.

*Primary Examiner* — Edwin A. Leon
*Assistant Examiner* — Milagros Jeancharles

(57) ABSTRACT

An electrical connector having a housing with a mating face and a wire-receiving face. Terminal-receiving cavities extend from the mating face toward the wire-receiving face. A receiving cavity extends from the wire-receiving face to an end wall provided at an end of the terminal-receiving cavities. The receiving cavity has a first section provided proximate the wire-receiving face and a second section provided proximate the end wall at the end of the terminal-receiving cavities. A transition wall is provided between the first section and the second section. A rear cover member is provided proximate the wire-receiving face. The receiving cavity is configured to receive a gang sealing member in the first section or individual wire sealing members in the second section to form a seal between the housing and the respective gang sealing member or the individual wire sealing members.

13 Claims, 3 Drawing Sheets

(56) References Cited

U.S. PATENT DOCUMENTS 4,832,616 A 5/1989 Stein, Sr. et al.
4,850,888 A * 7/1989 Denlinger ..... H01R 13/7032 439/188
4,921,437 A * 5/1990 Cooper ..... H01R 13/4223 439/275
5,211,589 A * 5/1993 McCardell ..... H01R 13/4364 439/176
5,240,433 A * 8/1993 Kato ..... H01R 13/5208 439/279
5,356,312 A * 10/1994 Abe ..... H01R 13/5205 439/278
5,545,062 A * 8/1996 Takagishi ..... H01R 13/4223 439/275
5,575,683 A * 11/1996 Saito ..... H01R 13/4365 439/595
5,607,318 A * 3/1997 Wakata ..... H01R 13/4223 439/274
5,720,629 A * 2/1998 Self, Jr. ..... H01R 13/5208 439/274
5,927,725 A * 7/1999 Tabata ..... H01R 13/5205 174/152 G
6,059,594 A * 5/2000 Davis ..... H01R 13/5205 439/275
6,364,692 B1 * 4/2002 Okayasu ..... H01R 13/5219 439/204
7,033,216 B2 * 4/2006 Ito ..... H01R 13/5208 439/275
7,044,762 B1 5/2006 Hong et al.
7,063,566 B2 * 6/2006 Tsuchiya ..... H01R 13/4223 439/587
7,156,698 B2 1/2007 Yamashita
7,211,731 B2 * 5/2007 Nagamine ..... H01R 13/5205 174/74 R
7,273,395 B2 9/2007 Hayashi
7,338,319 B2 * 3/2008 Casses ..... H01R 13/5208 439/274
7,553,186 B2 * 6/2009 Morikawa ..... H01R 13/5208 439/587
7,637,764 B2 * 12/2009 Yoneda ..... H01R 13/5208 439/275
7,658,644 B2 * 2/2010 Ahn ..... H01R 13/5208 439/587
7,993,170 B2 * 8/2011 Nakata ..... H01R 4/185 439/587
9,178,301 B2 11/2015 Shiga
9,252,505 B2 2/2016 Otsuka et al.
10,033,131 B2 * 7/2018 Uchiyama ..... H01R 13/5202
10,454,204 B2 * 10/2019 Hara ..... H01R 13/5208
2002/0086575 A1 * 7/2002 Marpoe, Jr. ..... H01R 13/64 439/352
2004/0092163 A1 * 5/2004 Nagayasu ..... H01R 13/5208 439/587
2005/0181681 A1 * 8/2005 Arai ..... H01R 4/4818 439/787
2008/0139029 A1 * 6/2008 Tsuji ..... H01R 13/4364 439/271
2009/0104805 A1 * 4/2009 Daudin ..... H01R 13/4365 439/274
2012/0142206 A1 6/2012 Buehman et al.
2012/0202368 A1 8/2012 Kuroda et al.
2015/0295346 A1 * 10/2015 Campbell ..... H01R 13/5208 439/589
2016/0036156 A1 * 2/2016 Iihoshi ..... H01R 13/5219 439/587
2018/0351281 A1 * 12/2018 Takamura ..... H01R 13/642
2019/0140389 A1 * 5/2019 Yi ..... H01R 13/4362
2019/0157797 A1 * 5/2019 McDowell ..... H01R 13/4367

* cited by examiner

ELECTRICAL CONNECTOR WHICH ACCEPTS DIFFERENT SEAL CONFIGURATIONS

FIELD OF THE INVENTION

The present invention relates to sealed electrical connectors. More specifically, the present invention relates to electrical connectors which accept different seal configurations.

BACKGROUND OF THE INVENTION

Electric connectors that prevent moisture from entering a housing of the electrical connector are commonly used in many industries. Generally, these sealed or waterproof connectors have a seal member formed of an elastomer arranged at a wire receiving opening of the housing where electric wires are connected to a contact or a fitting component of a mating connector. The seal member seals the entrance for the electric wires, which are connected to contacts inside the housing to prevent the influx of water therein. The seal member may either be an individual seal member where the seal member is individually attached to each of a plurality of the electric wires or a collective or gang seal member where the seal member is attached to the plurality of the electric wires as a group.

Typical individual wire seals are formed with flanges around an outside circumference of the seal member. The individual wire seals are positioned proximate the terminals provided at the ends of the wires and are inserted into terminal receiving passages of the housing of the connector. The flanges press against inside walls of the passages to seal the housing. The passages are thereby individually sealed to prevent the ingress of moisture.

Typical collective or gang seals are made from an elastomer and are formed to have a plurality of wire receiving through-holes. Terminals provided at the ends of the wires are inserted through the wire receiving through-holes and are inserted into terminal receiving passages of the housing of the connector. End walls or flanges of the collective or gang seal engage inside walls of a seal receiving cavity of the housing of the connector to seal the housing. The seal receiving cavity is thereby sealed to prevent the ingress of moisture.

While both individual wire seals and collective seals are effective, each seal has required a different housing in order to provide and maintain an effective seal. The need for multiple housings requires multiple tooling and increase inventory, as multiple parts are required, thereby increasing the cost of such part.

It would, therefore, be beneficial to provide a housing which provides and maintains an effective seal using either individual wire seals or collective seals. It would also be beneficial if the same housing could accept the wires and terminals in applications in which sealing is not required.

SUMMARY OF THE INVENTION

An embodiment is directed to an electrical connector having a housing with a mating face and a wire-receiving face. Terminal-receiving cavities extend from the mating face toward the wire-receiving face. A receiving cavity extends from the wire-receiving face to an end wall provided at an end of the terminal-receiving cavities. The receiving cavity has a first section provided proximate the wire-receiving face and a second section provided proximate the end wall at the end of the terminal-receiving cavities. A transition wall is provided between the first section and the second section. Terminals are positioned in the terminal-receiving cavities. The terminals are physically and electrically connected to wires which extend through the receiving cavity and the wire-receiving face. A rear cover member is provided proximate the wire-receiving face. The receiving cavity is configured to receive a gang sealing member in the first section or individual wire sealing members in the second section to form a seal between the housing and the respective gang sealing member or the individual wire sealing members.

An embodiment is directed to an electrical connector having a housing with a mating face and a wire-receiving face. Terminal-receiving cavities extend from the mating face toward the wire-receiving face. A seal-receiving cavity extends from the wire-receiving face to an end wall provided at an end of the terminal-receiving cavities. The seal-receiving cavity has a first section provided proximate the wire-receiving face and a second section provided proximate the end wall at the end of the terminal-receiving cavities. The second section has cylindrical seal-receiving passages which extend from the terminal-receiving cavities to the first section. A transition wall is provided between the first section and the second section. Terminals are positioned in the terminal-receiving cavities. The terminals are physically and electrically connected to wires which extend through the seal-receiving cavity and the wire-receiving face. One or more sealing members are provided in the seal-receiving cavities. The one or more sealing members cooperate with the housing and the wires to form a seal between the housing, the wires and the one or more sealing members. A rear cover member is provided proximate the wire-receiving face and extends across the wire-receiving face. The rear cover member engages the one or more sealing members to maintain the one or more sealing members in the seal-receiving cavity.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
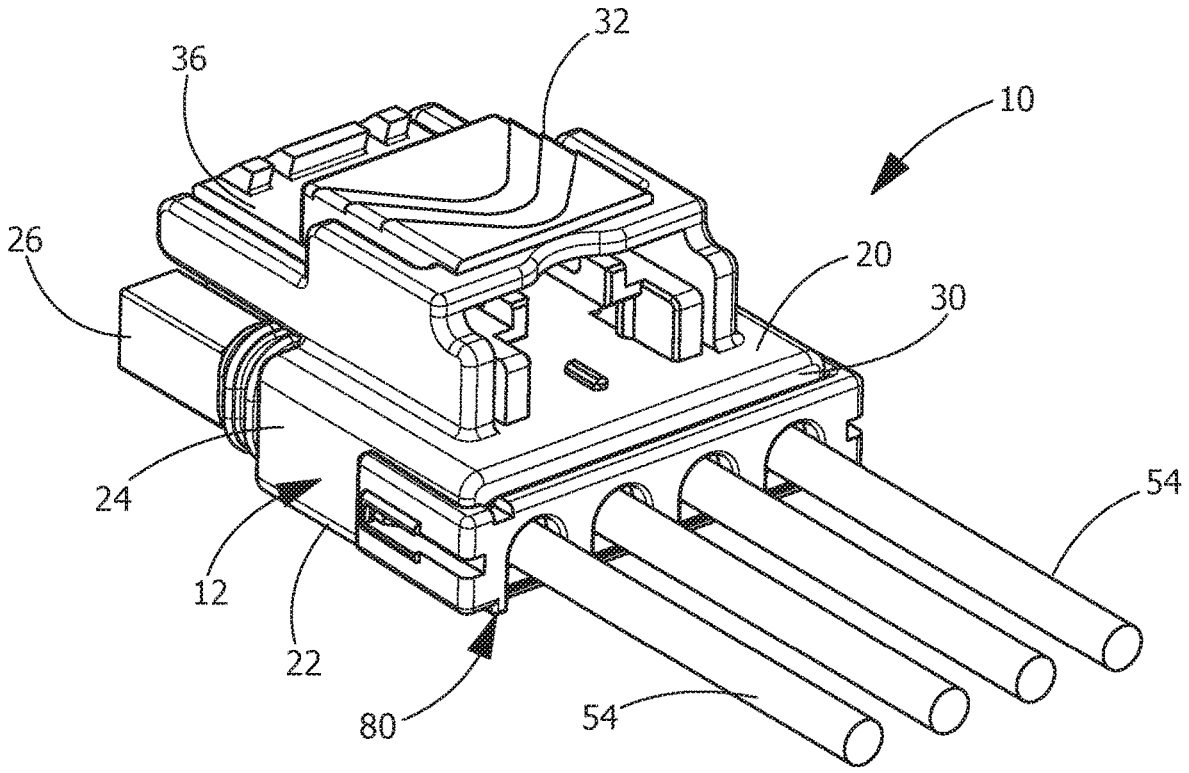
FIG. 1 is a perspective view of an illustrative embodiment of an electrical connector according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Referring to the embodiment shown in FIG. 1, an illustrative electrical connector 10 is shown. In the embodiment shown, a male electrical connector is shown. However, a female electrical connector may also be used without departing from the scope of the invention.

Referring to FIGS. 2 through 7, the connector 10 has housing 12 with a top surface or wall 20, an oppositely facing bottom surface or wall 22 and side surfaces or walls 24 which extend between the top wall 20 and the bottom wall 22. A forward mating face 26 extends between top wall 20, bottom wall 22 and side walls 24. Terminal-receiving cavities 28 extend from the mating face 26 toward a wire-receiving face 30.

Figure 5:
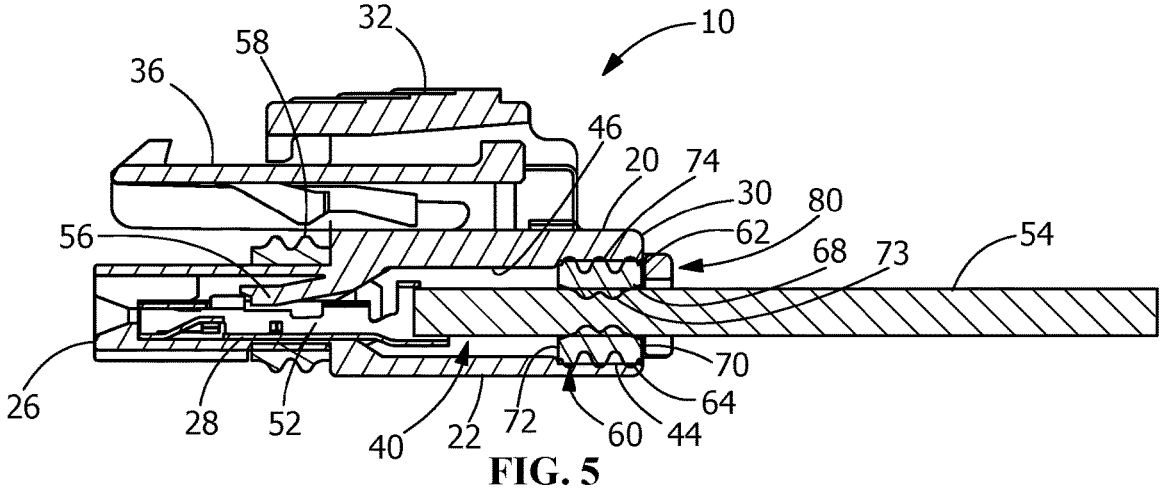
FIG. 5 is a cross-sectional view of the assembled connector of FIG. 2.
Figure 6:
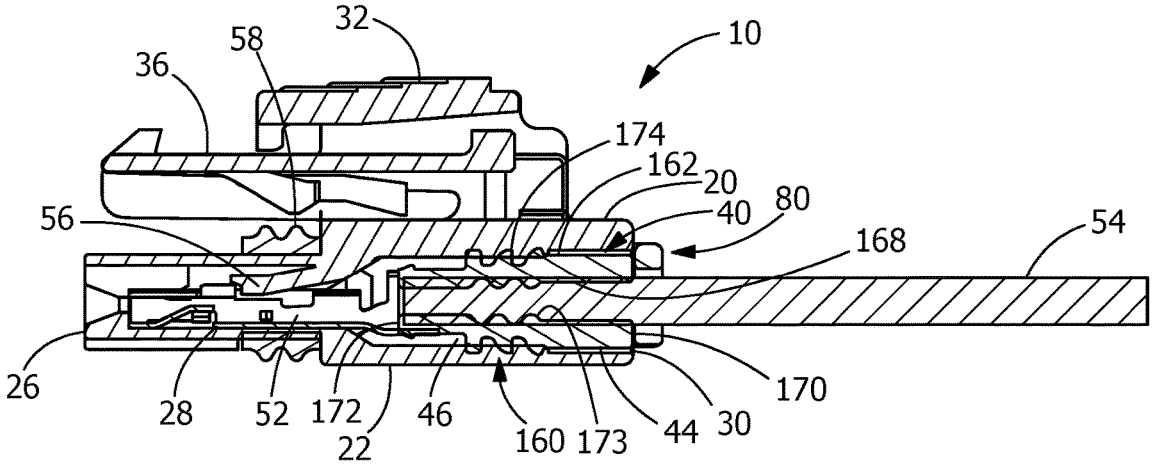
FIG. 6 is a cross-sectional view of the assembled connector of FIG. 3.
Figure 7:
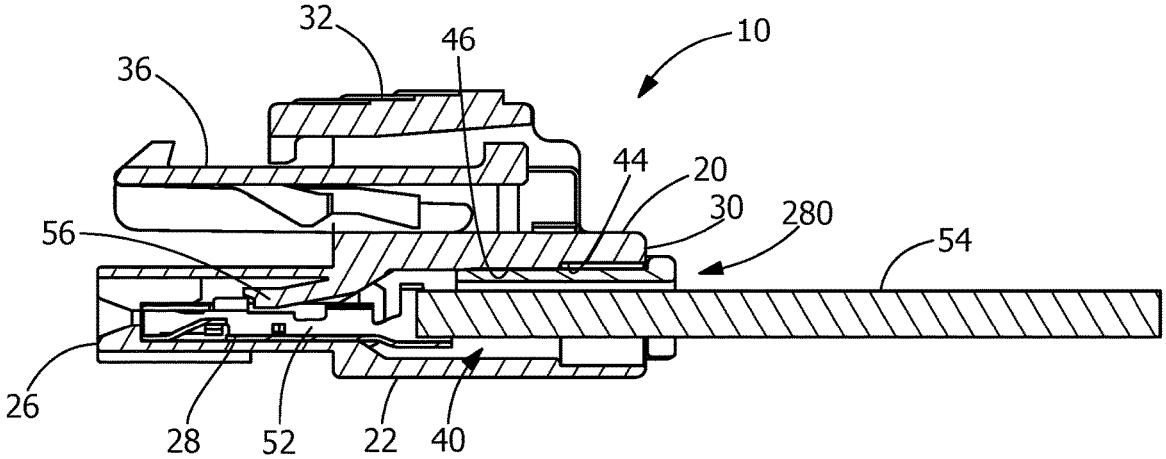
FIG. 7 is a cross-sectional view of the assembled connector of FIG. 4.

A seal-receiving cavity 40 extends from the wire-receiving face 30 to the terminal-receiving cavities 28. As best shown in FIGS. 5 through 7, the seal-receiving cavity 40 has a first section 44 and a second section 46. The first section 44 is positioned proximate to the wire-receiving face 30. The first section 44 of the seal-receiving cavity 40 extends from the top surface or wall 20 to the bottom surface or wall 22 and from the one side surface or wall 24 to the opposed side surface or wall 24. The second section 46 extends between the terminal-receiving cavities 28 and the first section 44. The second section 46 has a plurality of cylindrical seal-receiving passages 42. The first section 44 has a larger height and width than the cylindrical seal-receiving passages 42 of the second section 46. A transition wall 48 extends between the first section 44 and the second section 46. In the illustrative embodiment shown, the transition wall 48 extends from the top surface or wall 20, the bottom surface or wall 22 and the side surfaces or walls 24.

A mating connector latching area 32 extends from the top wall 20. In the illustrative embodiment shown, the mating connector latching area 32 is positioned between the mating face 26 and the wire-receiving face 30. However, the mating connector latching area 32 may be positioned in other locations along the top wall 20. In the illustrative embodiment shown, the mating connector latching area 32 includes a mating connector engagement arm 36. The engagement arm 36 extends in a direction which is essentially parallel to the top wall 20. However, other configurations of the engagement arm 36 may be used. The mating connector latching area 32 is configured to cooperate with a latching area of a mating connector (not shown).

As best shown in FIGS. 5 through 7, terminals 52, which are physically and electrically connected to wires or conductors 54, are inserted into the terminal-receiving cavities 28 and are retained therein by resilient terminal latching arms 56. The particular configuration of the terminals 52 and the resilient terminal latching arms 56 are shown for illustrative purposes but may vary. The wires or conductors 54 extend from the terminal-receiving cavities 28 through the seal-receiving cavity 40 and the wire-receiving face 30.

In various embodiments, a peripheral seal 58 may be provided proximate the mating face 26. The peripheral seal 58 cooperates with the mating connector, as is known in the art.

Figures 2, 3, 4:
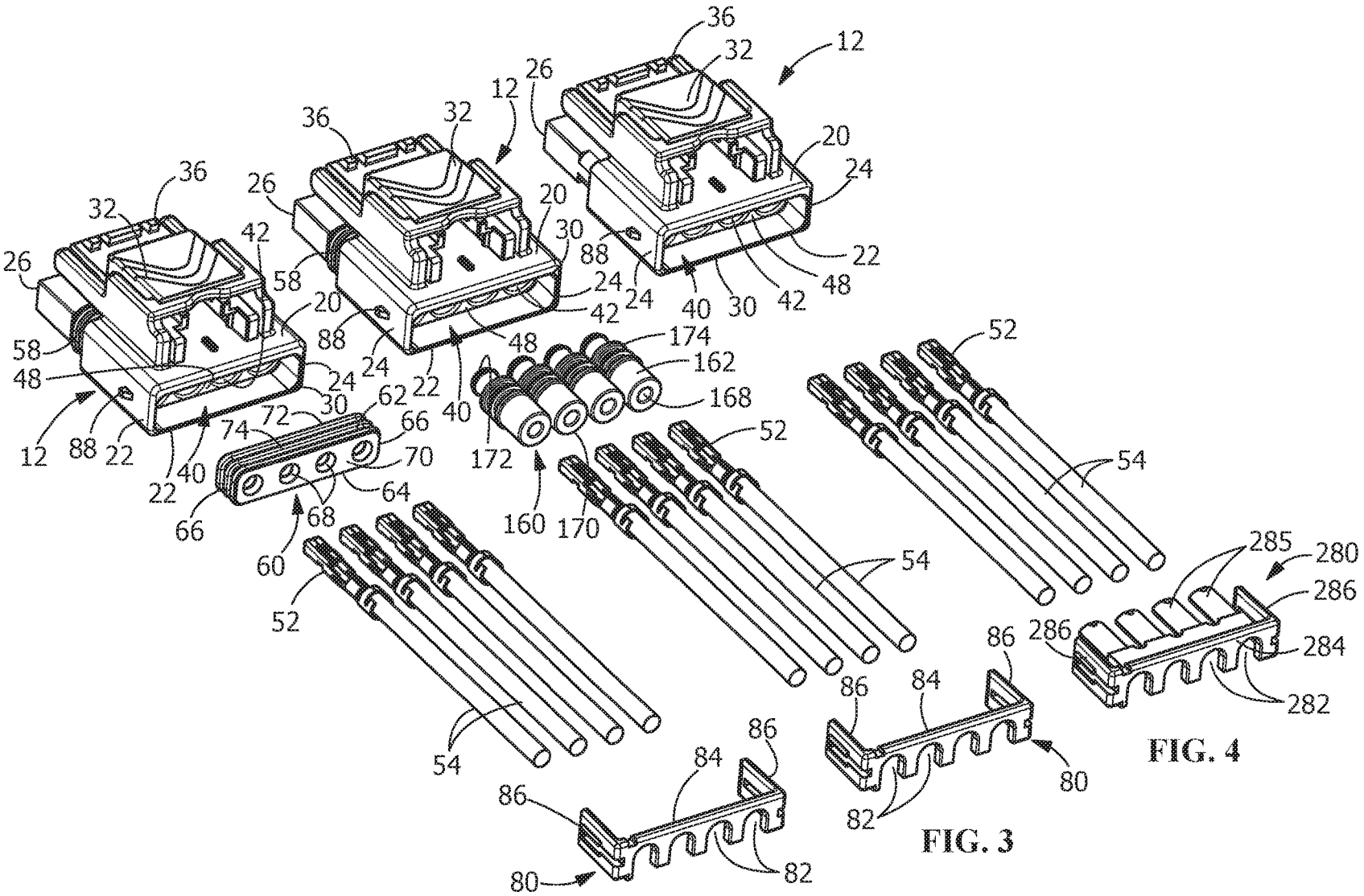
FIG. 2 is an exploded perspective view of an illustrative electrical connector of FIG. 1, the electrical connector includes a collective or gang seal.
FIG. 3 is an exploded perspective view of an illustrative electrical connector of FIG. 1, the electrical connector includes individual wire seals.
FIG. 4 is an exploded perspective view of an illustrative electrical connector of FIG. 1, the electrical connector does not include any seals.

In the embodiment shown in FIGS. 2 and 5, a collective or gang sealing member 60 is provided proximate the rear wire-receiving face 30. The gang sealing member 60 has a top surface 62, an oppositely facing bottom surface 64 and side surfaces 66. Wire-receiving openings 68 extend through the collective or gang sealing member 60 from an outwardly facing first surface 70 to an inwardly facing second surface 72. The wire-receiving openings 68 are dimensioned to allow the wires or conductors 54 to be inserted therein. However, the wire-receiving openings 68 have inside diameters which are slightly smaller than outside diameters of the wires or conductors 54, allowing the wire-receiving openings 68 to form seals with the wires or conductors 54.

The wire-receiving openings 68 may also have ribs or projections 73 which extend inward from the walls of the wire-receiving openings 68. The number and dimension of the ribs or projections 73 may vary.

Ribs or projections 74 extend from the top surface 62, the bottom surface 64 and side surfaces 66. The number and dimension of the ribs or projections 74 may vary.

The gang sealing member 60 is made of any material which prevents moisture or contaminants from entering the housing 12 of the connector 10 through gaps where the wires or conductors 54 enter the rear wire-receiving face 30 of the connector 10. For example, the gang sealing member 60 may be made from elastomeric material such as silicon rubber.

When inserted into the seal-receiving cavity 40, the inwardly facing second surface 72 of the gang sealing member 60 engages the transition wall 48 to position and maintain the gang sealing member 60 in the first section 44 and prevent the gang sealing member 60 from moving to the second section 46. In this position, the ribs or projections 74 and the gang sealing member 60 are compressed to form a seal between the ribs or projections 74 and the first section 44 of the seal-receiving cavity 40. The compression of the gang sealing member 60 also causes the wire-receiving openings 68 and the ribs or projections 73 to further compress around the wires or conductors 54 to enhance the seal between the wire-receiving openings 68 and the wires or conductors 54.

A rear seal cover member 80 is positioned proximate the rear wire-receiving face 30. The rear seal cover member 80 is a separate molded member with conductor receiving cavities 82, a seal engaging portion 84 and two resilient latching arms 86 which extend from either side of the seal engaging portion 84. When moved into position proximate the rear wire-receiving face 30, the seal engaging portion 84 spans the rear wire-receiving face 30 and engages the outwardly facing surface 70 of the gang sealing member 60.

The resilient latching arms 86 are configured to engage and cooperate with the cover latching members 88 positioned on the side walls 24 of the housing 12 of the connector 10. The rear seal cover member 80 is positioned over the rear wire-receiving face 30 after the terminals 52 have been inserted into the terminal-receiving cavities 28 and the gang sealing member 60 have been inserted into the first section 44 of the seal-receiving cavity 40. The rear seal cover member 80 maintains the gang sealing member 60 in position in the connector 10.

In the embodiment shown in FIGS. 3 and 6, multiple individual sealing members 160 are provided proximate the rear wire-receiving face 30. Each individual seal member 160 cooperates with a respective conductor 54. The individual sealing members 160 have generally cylindrical configurations with outer walls 162. Wire-receiving openings 168 extend through the individual wire seals 160 from outwardly facing first surfaces 170 to inwardly facing second surfaces 172. The wire-receiving openings 168 are dimensioned to allow the wires or conductors 54 to be inserted therein. However, each of the wire-receiving openings 168 has an inside diameter which is slightly smaller than an outside diameter of a respective wire or conductor 54, allowing each of the wire-receiving openings 168 to form a seal with its respective wire or conductor 54. The wire-receiving openings 168 may also have ribs or projections 173 which extend inward from the walls of the wire-receiving openings 168. The number and dimension of the ribs or projections 173 may vary.

Ribs or projections 174 extend from the outer walls 162 of the individual sealing members 160. The number and dimension of the ribs or projections 174 may vary.

The individual sealing members 160 are made of any material which prevents moisture or contaminants from entering the housing 12 of the connector 10 through gaps where the wires or conductors 54 enter the rear wire-receiving face 30 of the connector 10. For example, the individual sealing members 160 may be made from elastomeric material such as silicon rubber.

When inserted into the seal-receiving cavity 40, the individual sealing members 160 are inserted into the cylindrical seal-receiving passages 42 such that the inwardly facing second surfaces 172 of the individual sealing members 160 are positioned proximate the terminal-receiving cavities 28. In this position, the ribs or projections 174 and the individual sealing members 160 are compressed to form a seal between the ribs or projections 174 and the walls of the cylindrical seal-receiving passages 42 of the second section 46 of the seal-receiving cavity 40. The compression of the individual sealing members 160 also causes the wire-receiving openings 168 and the ribs or projections 173 to further compress around the wires or conductors 54 to enhance the seal between the wire-receiving openings 168 and the wires or conductors 54. In the illustrative embodiment shown, the individual sealing members 160 extend from the terminal-receiving cavities 28 to proximate the wire-receiving face 30. In this position, the individual sealing members 160 extend through the first section 44 and the cylindrical seal-receiving passages 42 of the second section 46.

As the individual sealing members 160 are positioned on the wires or conductors 54 prior to the terminals 52 being crimped to the wires or conductors 54, the sharp edges of the terminals do not tear or distort the wire-receiving openings 168. Consequently, the individual sealing members 160 properly conform to the wires or conductors 54 and to the cylindrical seal-receiving passages 42 of the second section 46 of the seal-receiving cavity 40, thereby allowing the individual sealing members 160 to have a higher seal rating than the gang sealing member 60.

A rear seal cover member 80 is positioned proximate the rear wire-receiving face 30. The rear seal cover member 80 is a separate molded member with conductor receiving cavities 82, a seal engaging portion 84 and two resilient latching arms 86. When moved into position proximate the rear wire-receiving face 30, the seal engaging portion 84 spans the rear wire-receiving face 30. The seal engaging portion 84 cooperates with the outwardly facing first surfaces 170 of the individual sealing members 160 to facilitate the proper position of the individual sealing members 160 in the second section 46 of the seal-receiving cavity 40.

The resilient latching arms 86 are configured to engage and cooperate with the cover latching members 88 positioned on the side walls 24 of the housing 12 of the connector 10. The rear seal cover member 80 is positioned over the rear wire-receiving face 30 after the terminals 52 and the individual sealing members 160 have been inserted into the terminal-receiving cavities 28 to maintain the individual sealing members 160 and terminals 52 in position in the connector 10. If any terminal 52 is not fully seated into its respective terminal-receiving cavity 28, the individual sealing member 160 which cooperates with the unseated terminal 52 may, in some instances, prevent the seal engaging portion 84 from being fully inserted, which may prevent the resilient latching arms 86 of the rear seal cover member 80 from engaging or latching to cover latching members 88. Consequently, under certain circumstances, the cover member 80 may help alert the assembler to check for one or more unseated terminals.

In the embodiment shown in FIGS. 4 and 7, no type of multiple sealing members 160 is provided in the seal-receiving cavity 40. In such embodiments, a rear cover member 280 is positioned proximate the rear wire-receiving face 30. The rear cover member 280 is a separate molded member with conductor receiving cavities 282, a back wall 284 and two resilient latching arms 286. When moved into position proximate the rear wire-receiving face 30, the back wall 284 spans the rear wire-receiving face 30 and has terminal engaging arms 285 which are dimensioned to extend through the first section 44 and the second section 46 of the seal-receiving cavity 40. The terminal engaging arms 285 engage a back surface of the terminals 52 to facilitate the proper position of the terminals 52 in the terminal-receiving cavities 28, thereby providing terminal position assurance. The terminal engaging arms 285 extend from the back wall 284 at a distance to allow the terminal engaging arms 285 to move past the transition wall 48 between the first section 44 and the second section 46 to position free ends 287 of the terminal engaging arms 285 in the cylindrical seal-receiving passages 42 of the second section 46.

The resilient latching arms 286 are configured to engage and cooperate with the cover latching members 88 positioned on the side walls 24 of the housing 12 of the connector 10. The rear cover member 280 is positioned over the rear wire-receiving face 30 after the terminals 52 have been inserted into the terminal-receiving cavities 28 to maintain the individual terminals 52 in position in the connector 10. If any terminal 52 is not fully seated into its respective terminal-receiving cavity 28, the terminal engaging arms 285 will engage the unseated terminal 52 and move it into position. Alternatively, if the unseated terminals 52 cannot be properly positioned, the terminal engaging arms 285 cannot be properly inserted into the housing 12, preventing the resilient latching arms 286 of the rear cover member 280 from engaging or latching to cover latching members 88, thereby alerting the assembler to check for one or more unseated terminals.

The housing 12 of the connector 10 is configured to properly receive and maintain either a gang sealing member 60 or individual sealing members 160 or terminal engaging arms 285 therein. As one housing can be manufactured to accommodate different sealing members, the costs associated with the connector 10 are reduced, as manufacturing and inventory costs are reduced. In addition, end users or installers benefit as the gang sealing members 60 or individual sealing members 160 can be used in the same connector 10, thereby allowing the installers to use the same connector in different applications or environments.

While the invention has been described with reference to a preferred embodiment, it will be understood by those skilled in the art that various changes may be made, and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having a mating face and a wire-receiving face, terminal-receiving cavities extend from the mating face toward the wire-receiving face, a seal-receiving receiving cavity extends from the wire-receiving face to an end wall provided at an end of the terminal-receiving cavities, the seal-receiving receiving cavity has a first section provided proximate the wire-receiving face and a second section provided proximate the end wall at the end of the terminal-receiving cavities, the first section of the seal-receiving cavity extends from a top surface of the housing to a bottom surface of the housing and from one side surface of the housing to an opposed side surface of the housing, the second section extends between the terminal-receiving cavities and the first section, the second section has a plurality of cylindrical seal-receiving passages, the first section has a larger height and width than the cylindrical seal-receiving passages of the second section, a transition wall provided between the first section and the second section, the transition wall extends from the top surface, the bottom surface and the side surfaces;

terminals positioned in the terminal-receiving cavities, the terminals being physically and electrically connected to wires which extend through the terminal receiving cavity and the wire-receiving face;

a rear cover member provided proximate the wire-receiving face;

wherein the first section of the seal-receiving receiving cavity is configured to receive a gang sealing member and the second section of the seal-receiving cavity is configured to receive individual wire sealing members;

wherein with the gang sealing member inserted into the first section, ribs which extend from outer walls of the gang sealing member engage walls of the housing of the first section to form a seal between the outer walls of the gang sealing member and the walls of the housing of the first section;

wherein with the individual wire sealing members inserted into the second section, ribs which extend from outer walls of the individual wire sealing members engage walls of the housing of the second section to form a seal between the outer walls of the individual wire sealing members and the walls of the housing of the second section.

2. The electrical connector as recited in claim 1, wherein the gang sealing member has an outwardly facing first surface and an inwardly facing second surface, the inwardly facing second surface of the gang sealing member engages the transition wall to position and maintain the gang sealing member in the first section and prevent the gang sealing member from moving to the second section.

3. The electrical connector as recited in claim 2, wherein wire-receiving openings extend through the gang sealing member from the outwardly facing first surface to the inwardly facing second surface, the wire-receiving openings are configured to allow the wires to be inserted therein, the wire-receiving openings have inside diameters which are smaller than outside diameters of the wires.

4. The electrical connector as recited in claim 2, wherein the ribs which extend from outer walls of the gang sealing member extend from a top surface, a bottom surface and side surfaces of the gang sealing member.

5. The electrical connector as recited in claim 2, wherein the rear cover member has conductor receiving cavities, a seal engaging portion and two resilient latching arms which extend from either side of the seal engaging portion.

6. The electrical connector as recited in claim 5, wherein the seal engaging portion spans the rear wire-receiving face and engages the outwardly facing surface of the gang sealing member, the resilient latching arms engage and cooperate with cover latching members positioned on side walls of the housing to maintain the rear cover member and the gang sealing member in position in the housing of the connector.

7. The electrical connector as recited in claim 1, wherein the individual wire sealing members have a cylindrical configuration with outwardly facing first surfaces and inwardly facing second surfaces, the inwardly facing second surfaces of the individual wire sealing members are positioned proximate the terminal-receiving cavities, the individual wire sealing members extend from the cylindrical seal-receiving passages of the second section through the first section to proximate the wire-receiving face.

8. The electrical connector as recited in claim 7, wherein wire-receiving openings extend through the individual wire sealing members from the outwardly facing first surfaces to the inwardly facing second surfaces, the wire-receiving openings are configured to allow the wires to be inserted therein.

9. The electrical connector as recited in claim 8, wherein the wire-receiving openings have inside diameters which are smaller than outside diameters of the wires.

10. The electrical connector as recited in claim 7, wherein the rear cover member has conductor receiving cavities, a seal engaging portion and two resilient latching arms which extend from either side of the seal engaging portion.

11. The electrical connector as recited in claim 10, wherein the seal engaging portion spans the rear wire-receiving face and engages the outwardly facing surfaces of the individual wire sealing members, the resilient latching arms engage and cooperate with cover latching members positioned on side walls of the housing to maintain the rear cover member and the individual wire sealing members in position in the housing of the connector.

12. An electrical connector comprising:

a housing having a mating face and a wire-receiving face, terminal-receiving cavities extend from the mating face toward the wire-receiving face, a receiving cavity extends from the wire-receiving face to an end wall provided at an end of the terminal-receiving cavities, the receiving cavity has a first section provided proximate the wire-receiving face and a second section provided proximate the end wall at the end of the terminal-receiving cavities, a transition wall provided between the first section and the second section;

terminals positioned in the terminal-receiving cavities, the terminals being physically and electrically connected to wires which extend through the receiving cavity and the wire-receiving face;

a rear cover member provided proximate the wire-receiving face, the rear cover member has conductor receiving cavities, a back wall and two resilient latching arms, the back wall spans the rear wire-receiving face and has terminal engaging arms which extend through the first section and the second section of the receiving cavity, the terminal engaging arms engage a back surface of the terminals to facilitate the proper position of the terminals in the terminal-receiving cavities, the terminal engaging arms are not aligned with the transition wall between the first section and the second section, allowing free ends of the terminal engaging arms to be positioned in the second section;

wherein the resilient latching arms engage and cooperate with cover latching members positioned on side walls of the housing to maintain the rear cover member and the terminals in position in the housing of the connector.

13. The electrical connector as recited in claim 12, wherein the terminal engaging arms extend from the rear cover member, the terminal engaging arms engage a back surface of the terminals to facilitate the proper position of the terminals in the terminal-receiving cavities.

* * * * *